US008661600B2

(12) United States Patent
Yamada

(10) Patent No.: US 8,661,600 B2
(45) Date of Patent: Mar. 4, 2014

(54) CLEANING SHEET

(76) Inventor: Kikuo Yamada, Tokyo (JP)

( * ) Notice: Subject to any disclaimer, the term of this patent is extended or adjusted under 35 U.S.C. 154(b) by 356 days.

(21) Appl. No.: 13/062,876

(22) PCT Filed: Sep. 7, 2009

(86) PCT No.: PCT/JP2009/065603
§ 371 (c)(1),
(2), (4) Date: Mar. 8, 2011

(87) PCT Pub. No.: WO2010/029902
PCT Pub. Date: Mar. 18, 2010

(65) Prior Publication Data

US 2011/0154598 A1 Jun. 30, 2011

(30) Foreign Application Priority Data

Sep. 9, 2008 (JP) ..... 2008-231061
Mar. 4, 2009 (JP) ..... 2009-051047

(51) Int. Cl.
*A47L 13/16* (2006.01)

(52) U.S. Cl.
USPC ..... 15/208; 428/136

(58) Field of Classification Search
USPC ..... 15/208–210.1; 428/131–138
See application file for complete search history.

(56) References Cited

U.S. PATENT DOCUMENTS 3,962,743 A 6/1976 Moss
4,510,640 A 4/1985 Omori
5,292,582 A 3/1994 Gibbs et al.
6,830,801 B1 * 12/2004 Kenmochi et al. ..... 428/136
7,037,569 B2 * 5/2006 Curro et al. ..... 428/138
7,404,227 B2 * 7/2008 Otsuka et al. ..... 15/228
D634,905 S * 3/2011 Adams et al. ..... D32/40
2003/0028985 A1 2/2003 Prodoehl et al.
2003/0097725 A1 * 5/2003 Smith ..... 15/104.93
2003/0121116 A1 7/2003 Keck et al.
2004/0128786 A1 7/2004 Policicchio et al.
2010/0306946 A1 * 12/2010 Pung et al. ..... 15/209.1

FOREIGN PATENT DOCUMENTS

EP 0 945 251 A1 9/1999
JP U-3-65548 3/1991
JP A-6-14859 1/1994
JP 08-131386 * 5/1996
JP A-8-182644 7/1996
JP A-11-267079 10/1999

(Continued)

OTHER PUBLICATIONS

International Preliminary Report on Patentability issued in corresponding International Patent Application No. PCT/JP2009/065603 dated Apr. 19, 2011.
Dec. 28, 2011 Extended Search Report issued in European Patent Application No. 09813048.7.

(Continued)

*Primary Examiner* — Laura C Guidotti
(74) *Attorney, Agent, or Firm* — Oliff PLC

(57) ABSTRACT

The invention provides a cleaning sheet that is excellent in capturing dust and dirt. The cleaning sheet according to the invention includes a base material sheet (2) and a cleaning surface forming sheet (3) that is bonded to the base material sheet (2). A slacked section (5) is formed in the cleaning surface forming sheet (2) between the bonding sections (6, 6) where the base material sheet (2) and the cleaning surface forming sheet (3) are bonded to each other, and a plurality of cuts (7) for capturing dust and dirt are formed at the slacked section (5).

10 Claims, 16 Drawing Sheets

(56) References Cited

FOREIGN PATENT DOCUMENTS

| | | |
|---|---|---|
| JP | A-2004-313516 | 11/2004 |
| JP | A-2005-34386 | 2/2005 |
| JP | A-2006-503674 | 2/2006 |
| JP | A-2007-44270 | 2/2007 |

OTHER PUBLICATIONS

International Search Report mailed on Dec. 8, 2009 issued in International Patent Application No. PCT/JP2009/065603 (with translation).

* cited by examiner (a)

(b)

(a)

(b)

(a)

(b)

(a)

(b)

(a)

(b)

(a)

(b)

CLEANING SHEET

TECHNICAL FIELD

The present invention relates to a cleaning sheet for use in cleaning floors, walls, and the like of a house.

BACKGROUND ART

In the past, various products have been provided as a cleaning sheet for removing dust and dirt that adhere to floors, walls, and windows of houses, furniture, or the like. In cases of many products, a cleaning sheet is produced using nonwoven fabric as a material. A cleaning sheet is mounted on a base plate of a cleaning device including a long handle, and is used while being held on the base plate. Alternatively, a cleaning sheet is applied to a cleaning device that includes a relatively short grip handle and a leg part, and is used while the leg part is inserted into a holding portion of the cleaning sheet so that the cleaning sheet is held on the grip handle.

A cleaning sheet, which uses nonwoven fabric as a material, is generally a disposable product, and requires low manufacturing cost and excellent wiping capacity.

Patent Document 1 discloses a cleaning sheet that is formed by forming many cuts at a sheet formed of nonwoven fabric. According to this cleaning sheet, dust and dirt are captured by cuts so that a cleaning target surface is cleaned.

CITATION LIST

Patent literature

Patent Document 1: Japanese Utility Model Application Laid-Open (JP-U) No. 3-65548

SUMMARY OF INVENTION

Technical Problem

The cleaning sheet disclosed in Patent Document 1 has excellent wiping capacity as compared to a nonwoven fabric sheet that is not subjected to any processing, but does not capture a sufficient amount of dust and dirt.

In particular, the cleaning sheet is poor at capturing relatively big granulated dirt.

The invention has been made in consideration of the above-mentioned problem, and an object of the invention is to provide a cleaning sheet that can reliably capture relatively big granulated dirt and efficiently perform cleaning.

Solution to Problem

The invention is a cleaning sheet including a base material sheet; and a cleaning surface forming sheet that is bonded to the base material sheet, wherein the cleaning surface forming sheet has a slacked section formed between bonding sections where the base material sheet and the cleaning surface forming sheet are bonded to each other, and, a plurality of cut portions for capturing dust and dirt are formed at the slacked section.

A distance L1 between the bonding sections of the base material sheet bonded with the cleaning surface forming sheet at the slacked section and a distance L2 between the bonding sections of the cleaning surface forming sheet bonded with the base material sheet at the slacked section are satisfied with a relationship expressed by a formula of "L1<L2".

The plurality of cut portions may be formed by cuts or slits, or by through holes. The shape of slits or through holes may be formed optionally.

If the plurality of cut portions is formed by a plurality of slits, it is preferable to form a predetermined pattern of the plurality of cut portions by disposing the plurality of slits in a state such that the longitudinal direction of the plurality of slits may be parallel to the longitudinal direction of the bonding sections.

The bonding sections where the cleaning surface forming sheet and the base material sheet are bonded to each other may be positioned at the end edge portions of the cleaning surface forming sheet. However, the portions inside the end edge portions of the cleaning surface forming sheet may be bonded to the base material sheet to form the bonding sections. In the case of the latter, extension portions of the cleaning surface forming sheet are formed between the bonding sections and the end edge portions of the cleaning surface forming sheet. Cuts may be formed at the extension portions so that strip sections are formed.

Band pieces may be provided on the extension portions, and cuts may be formed at the extension portions and the band pieces, so that strip sections are formed.

A folded plate, which includes a base portion and a slope portion folded and extended from the base portion, may be provided on the extension portions. In this case, it is preferable that an adhesive surface be formed on the slope portion of the folded plate.

The extension portions may be folded so that curvedly folded portions are formed, and cuts may be formed at the curvedly folded portions so that hollow strip sections are formed.

A plurality of bonding sections may be provided at which the base material sheet and the cleaning surface forming sheet are bonded to each other, and the plurality of bonding sections may be provided to form a plurality of slacked sections. In this case, the plurality of slacked sections may be formed so as to have the different heights. In an embodiment where the heights of the plurality of slacked sections are different from each other, it is preferable to form the plurality of slacked sections in a state such that the height of a slacked section formed in the middle portion of the cleaning surface forming sheet is the highest and the heights of the slacked sections are gradually reduced toward in a direction of the both end portions of the cleaning surface forming sheet.

When the plurality of slacked sections is to be formed at the cleaning surface forming sheet, flat sections including a plurality of opening holes are formed between the plurality of slacked sections and each of the flat sections may be bonded to the base material sheet by an adhesive, to form the bonding sections. Since the flat sections are bonded to the base material sheet by an adhesive, an adhesive layer is formed between the flat sections and the base material sheet. The adhesive layer is exposed to the outside through the opening holes of the flat sections.

The cleaning surface forming sheet may be bonded to one surface of the base material sheet or respectively to the front and back surfaces of the base material sheet.

It is preferable that each of the base material sheet and the cleaning surface forming sheet is formed of nonwoven fabric.

Advantageous Effects of Invention

A cleaning sheet according to the invention includes a base material sheet and a cleaning surface forming sheet that is bonded to the base material sheet. The cleaning surface forming sheet has a slacked section formed between bonding sections where the base material sheet and the cleaning surface forming sheet are bonded to each other, and a plurality of cut portions for capturing dust and dirt are formed at the slacked section. Accordingly, when the cleaning target surface is cleaned using the cleaning sheet according to the invention, creases are formed at the slacked section of the cleaning surface forming sheet, so that bent portions having an irregular shape are formed. Accordingly, a frictional force between the cleaning sheet and the cleaning target surface increases. Due to this large frictional force, dust and dirt are reliably captured by the cut portions formed at the cleaning surface forming sheet. Accordingly, it may be possible to increase the captured amount of dust and dirt.

Therefore, according to the invention, there is provided a cleaning sheet that may have significantly improved wiping capacity even with a simple structure and allows easy and low-cost manufacturing.

DESCRIPTION OF EMBODIMENTS

Figure 1:
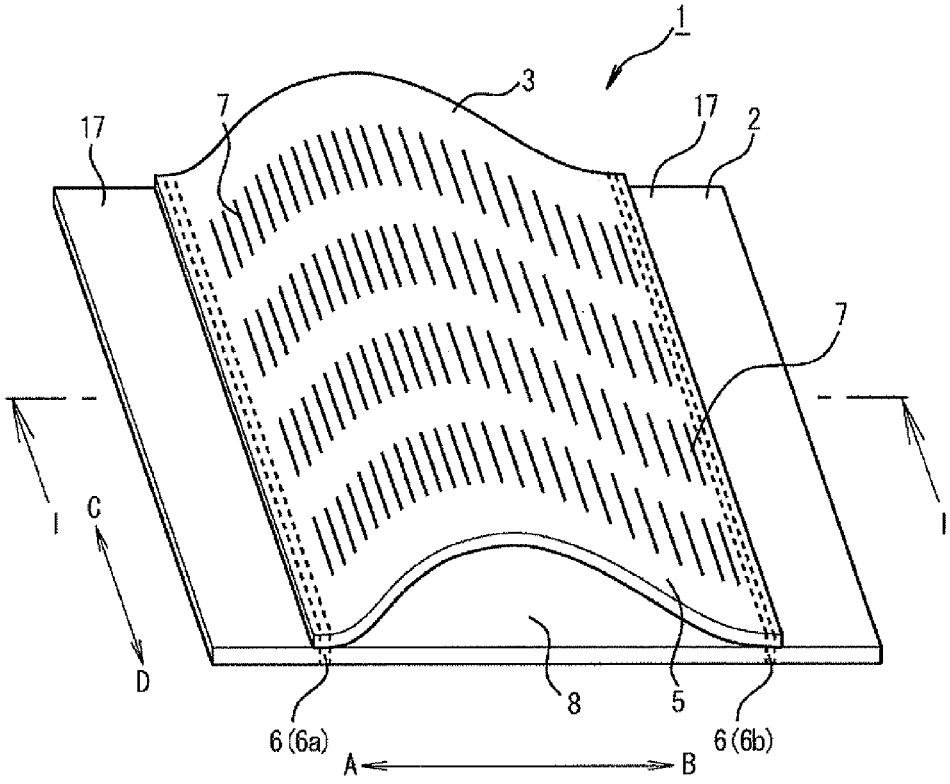
FIG. 1*a* is a perspective view of an embodiment of the invention where a plurality of cuts are formed as a plurality of cut portions.
FIG. 1*b* is a longitudinal sectional view taken along a line I-I of FIG. 1*a*.
Figure 1:
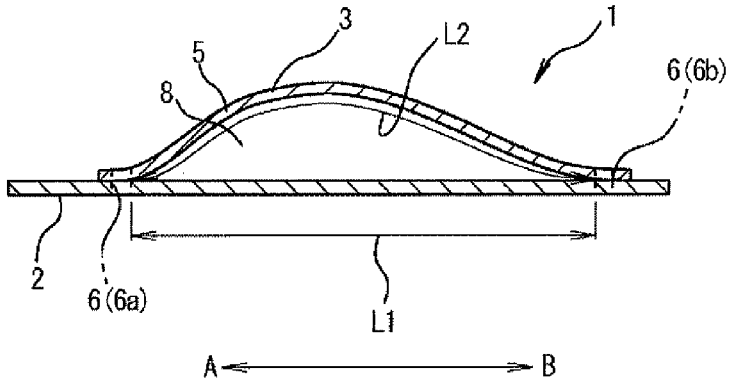

As shown in FIGS. 1*a* and 1*b*, a cleaning sheet 1 according to the invention includes a base material sheet 2 and a cleaning surface forming sheet 3 where a plurality of cut portions for capturing dust and dirt are formed. As the cut portions, many small cuts, or many small slits, may be formed by pressing a cutting blade against the cleaning surface forming sheet 3 or many small holes are formed by cutting out the cleaning surface forming sheet 3 in the shape of a slit-like, a circle, or the like. As described above, the invention includes an embodiment where the plurality of cut portions are formed by a plurality of cuts, or slits, and an embodiment where the plurality of cut portions are formed a plurality of small holes. The embodiment where the plurality of cut portions are formed of a plurality of cuts 7 is shown in FIG. 1*a*. As shown in FIG. 1*a*, the plurality of cuts 7 is formed in a predetermined pattern.

As shown in FIGS. 1*a* and 1*b*, the cleaning sheet 1 is formed by bonding the cleaning surface forming sheet 3 to the base material sheet 2 while the cleaning surface forming sheet is slack so that a space 8 is formed between the base material sheet 2 which has a rectangular shape and the cleaning surface forming sheet 3 which has a rectangular shape.

As shown in FIGS. 1*a* and 1*b*, the direction of an arrow A-B is a direction where slack is generated on the cleaning surface forming sheet 3.

As shown in FIGS. 1*a* and 1*b*, both left and right end edge portions of the cleaning surface forming sheet 3 are bonded to the base material sheet 2, so that bonding sections 6 are formed. In FIGS. 1*a* and 1*b*, a bonding section formed at one end edge portion is denoted by 6*a* and a bonding section formed at the other end edge portion is denoted by 6*b*.

The bonding sections 6*a* and 6*b* are formed at positions that are apart from the positions of both left and right end edge portions of the base material sheet 2 toward the inside by a predetermined distance. Further, these bonding sections 6*a* and 6*b* are formed in a direction parallel to both the left and right end edge portions of the base material sheet 2 (the direction of an arrow C-D in FIG. 1*a*).

The cleaning surface forming sheet 3 is bonded to the base material sheet 2 as it is slack. As a result, a slacked section 5 is formed convexly at the cleaning surface forming sheet 3.

A distance L1 (FIGS. 1B and 7A) along the base material sheet 2 between the bonding sections 6*a* and 6*b* of the base material sheet 2 bonded with the cleaning surface forming sheet 3 at the slacked section 5 and a distance L2 along the cleaning surface forming sheet 3 between the bonding sections 6*a* and 6*b* of the cleaning surface forming sheet 3 bonded with the base material sheet 2 at the slacked section 5 are satisfied with a relationship expressed by a formula of "L1<L2". That is, L1 denotes a horizontal straight-line distance between the bonding sections 6*a* and 6*b* on the base material sheet 2, and L2 denotes a horizontal straight-line distance between the bonding sections 6*a* and 6*b* when the cleaning surface forming sheet 3 is flattened.

The space 8 is formed between the base material sheet 2 and the slacked section 5. The cuts 7 of the cleaning surface forming sheet 3 are formed so as to pass through the cleaning surface forming sheet 3 from the front surface of the cleaning surface forming sheet toward the back surface of the cleaning surface forming sheet. Accordingly, The cuts 7 communicate with the space 8.

The shape of the cuts 7 may be provided optionally, such as a linear shape, a curved shape, a bent shape, or a shape of the combination of a straight line and a curved line. An embodiment where the cuts 7 are linearly or straightly formed is shown in FIG. 1*a*.

Figure 4:
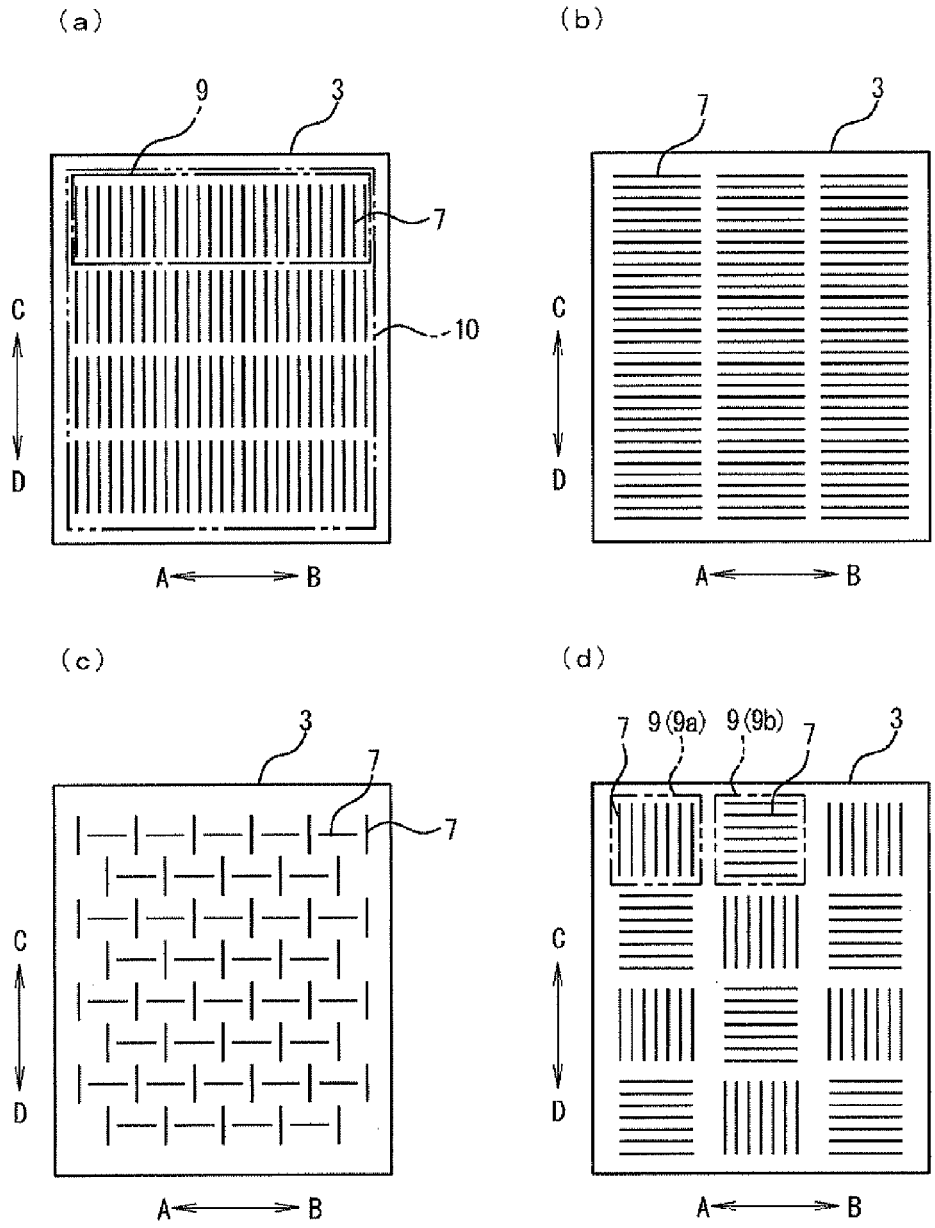
FIGS. 4*a*, 4*b*, 4*c*, and 4*d* are plan views showing the forming patterns of cuts.

The cuts 7 are linearly disposed at the cleaning surface forming sheet 3 shown in FIG. 1*a*. The longitudinal directions of the cuts 7 are parallel to the longitudinal direction of the bonding sections 6 (the direction of the arrow C-D). FIG. 4*a* shows that the cleaning surface forming sheet 3 including the cuts 7 is flattened.

As shown in FIG. 4*a*, each of the cuts 7 are arranged in the cleaning surface forming sheet 3 at predetermined intervals in the direction in which the slacking is generated in the cleaning surface forming sheet 3 (the direction of the arrow A-B) and one group of the cuts forms a cut column 9. Further, a plurality of cut columns 9 is formed in the direction of the arrow C-D, and the aggregation of these cut columns 9 forms a cut column group 10.

As for the cleaning sheet 1 shown in FIG. 1*a*, the end regions of the base material sheet 2, which are not covered with the cleaning surface forming sheet 3 and are disposed outside the left and right end edge portions to which the cleaning surface forming sheet 3 is bonded, are exposed, and the end regions of the base material sheet are shown as mounting sections 17 in FIG. 1*a*. The mounting sections 17 function as fixing pieces for locking and fixing the cleaning sheet to a base plate of a cleaning device when the cleaning sheet 1 is mounted on the base plate.

Various materials, such as nonwoven fabric, paper, woven fabric, and a synthetic resin, may be used as the material of each of the base material sheet 2 and the cleaning surface forming sheet 3 of the cleaning sheet 1. However, it is preferable that nonwoven fabric be used in terms of lightness, strength, durability, and adhesion.

When each of the base material sheet 2 and the cleaning surface forming sheet 3 is formed of nonwoven fabric, as the nonwoven fabric, spunlace nonwoven fabric, spunbond nonwoven fabric, thermal bond nonwoven fabric, air-through nonwoven fabric, point bond nonwoven fabric, and the like may be used. Natural fiber, synthetic fiber, composite fiber, and the like may be used as the fiber that is used to form nonwoven fabric.

It is preferable that the cleaning surface forming sheet 3 be made of a material having excellent elasticity. If the cleaning surface forming sheet 3 has excellent elasticity, the cuts 7 are pulled and are apt to be opened due to the friction between the cleaning surface forming sheet and the cleaning target surface during cleaning in the case of the pattern of the cuts shown in FIG. 1*a*. Accordingly, dust and dirt are easily captured. Examples of a material having excellent elasticity include spunlace nonwoven fabric.

In order to increase the mounting strength of the cleaning sheet when the cleaning sheet is mounted on the base plate of the cleaning device, it is preferable that spunbond nonwoven fabric or air-through nonwoven fabric be used as a material of the base material sheet 2.

Each of the base material sheet 2 and the cleaning surface forming sheet 3 may be formed of one piece of nonwoven fabric, or may be formed of a laminated body where a plurality of pieces of nonwoven fabric is superimposed.

Parts of the base material sheet 2 may be made of different materials. For example, portions of the base material sheet 2, which correspond to the mounting sections 17, may be made of a material having low elasticity, and other portions thereof may be made of a material having excellent elasticity.

The base material sheet 2 and the cleaning surface forming sheet 3 may be colored with the same color or different colors. Further, the base material sheet 2 and the cleaning surface forming sheet 3 may be formed so as to partially have portions that are colored with different colors. If the base material sheet and the cleaning surface forming sheet are formed as described above, it may be possible to improve the design of the cleaning sheet 1.

The shape of each of the base material sheet 2 and the cleaning surface forming sheet 3 is not limited to a rectangular shape, and may be an optionally shape, such as a polygonal shape or an elliptical shape.

The cuts 7 have been formed linearly at the cleaning surface forming sheet 3 shown in FIG. 1*a* (a plan view of the flattened cleaning surface forming sheet 3 is shown in FIG. 4*a*) so that the longitudinal directions of the cuts 7 are parallel to the longitudinal direction of the bonding sections 6 (the direction of the arrow C-D). However, the embodiment of the cuts 7 is not limited to the embodiment shown in FIGS. 1*a* and 4*a*, and the cuts 7 may be formed linearly as shown in FIG. 4*b* in a state such that the longitudinal directions of the cuts 7 are orthogonal to the direction of the arrow C-D. Further, although not particularly shown, the cuts 7 may be formed linearly in a state such that the longitudinal directions of the cuts 7 cross the direction of the arrow C-D at an angle smaller than 90°.

Furthermore, as shown in FIG. 4*c*, a plurality of cuts 7 of which the longitudinal directions are parallel to the direction of the arrow C-D and a plurality of cuts 7 of which the longitudinal directions are orthogonal to the direction of the arrow C-D may be alternately combined with each other so as to form cut columns 9.

Moreover, as shown in FIG. 4*d*, cut columns 9*a* including a plurality of cuts 7 of which the longitudinal directions are parallel to the direction of the arrow C-D and cut columns 9*b* including a plurality of cuts 7 of which the longitudinal directions are orthogonal to the direction of the arrow C-D may be alternately disposed so as to form cut column groups.

The cuts 7 are not limited to an embodiment where a plurality of cuts are disposed in a regular pattern, and may be disposed in an irregular pattern.

The bonding sections 6 of the cleaning sheet 1 shown in FIG. 1 have been formed in a linear shape. However, the bonding sections 6 are not limited thereto, and may be formed in a curved shape. Further, the bonding sections 6 may be formed in a discontinuous shape.

Examples of a method of forming the bonding section 6 may include heat sealing, adhesion using an adhesive, ultrasonic sealing, and the like.

A hot-melt adhesive, a two-liquid type curable adhesive, a thermoplastic resin adhesive, an elastomeric adhesive, a thermosetting resin adhesive, an instant adhesive, and the like may be used as the adhesive. It is preferable that the hot-melt adhesive among them be used in terms of a quick adhesion work using heating and cooling.

Figure 20:
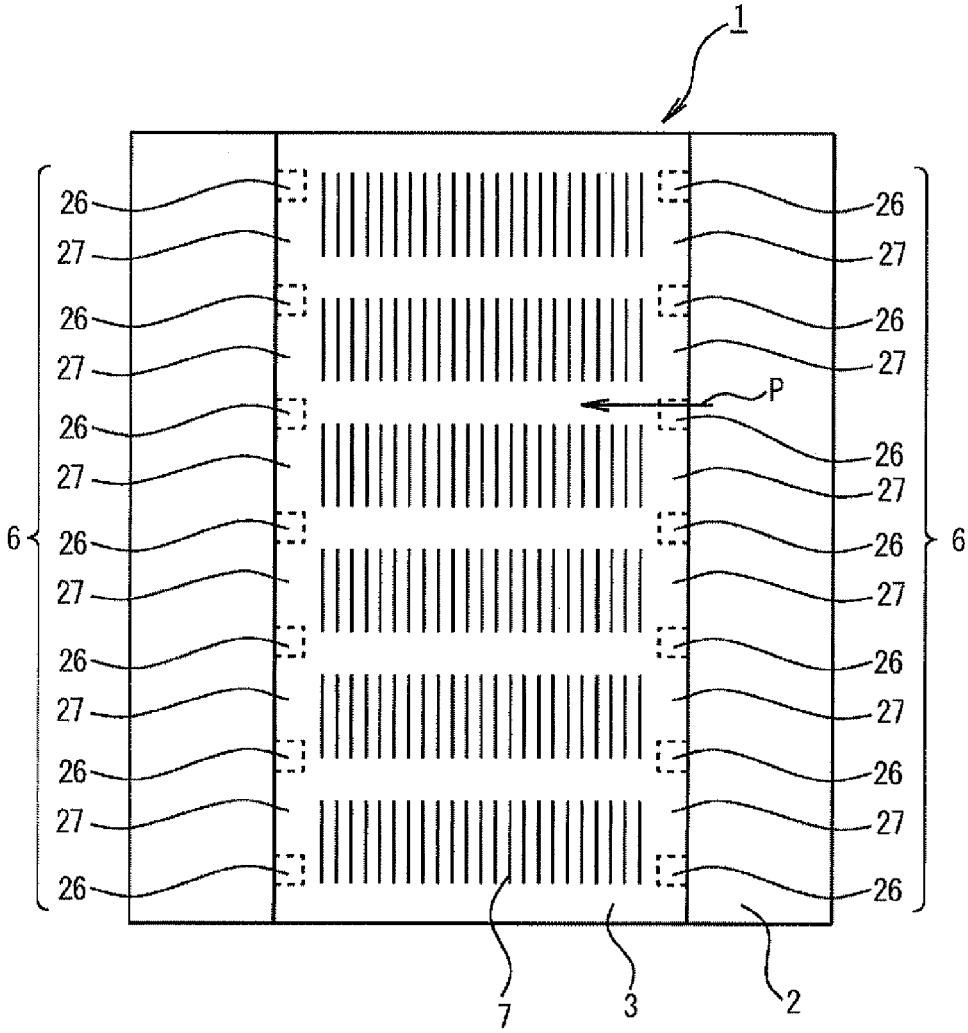
FIG. 20 is a plan view of an embodiment of the invention where bonding sections are formed in a discontinuous shape.

For the formation of the bonding section 6 in a discontinuous shape, for example, point-like heat fusion sections are formed by heat sealing. FIG. 20 shows an example of a cleaning sheet where the point-like heat fusion section 26 are formed. In FIG. 20, reference numeral 27 denotes a section that is not fused using heat.

Even in the cleaning sheet where the bonding sections 6 are formed in a discontinuous shape as described above, as in the case of the cleaning sheet where continuous bonding sections 6 are formed, dust and dirt are guided, for example, in the direction of an arrow P during cleaning and are captured by the cuts 7 disposed around the dust and dirt. Accordingly, dust and dirt are wiped out.

Figure 5:
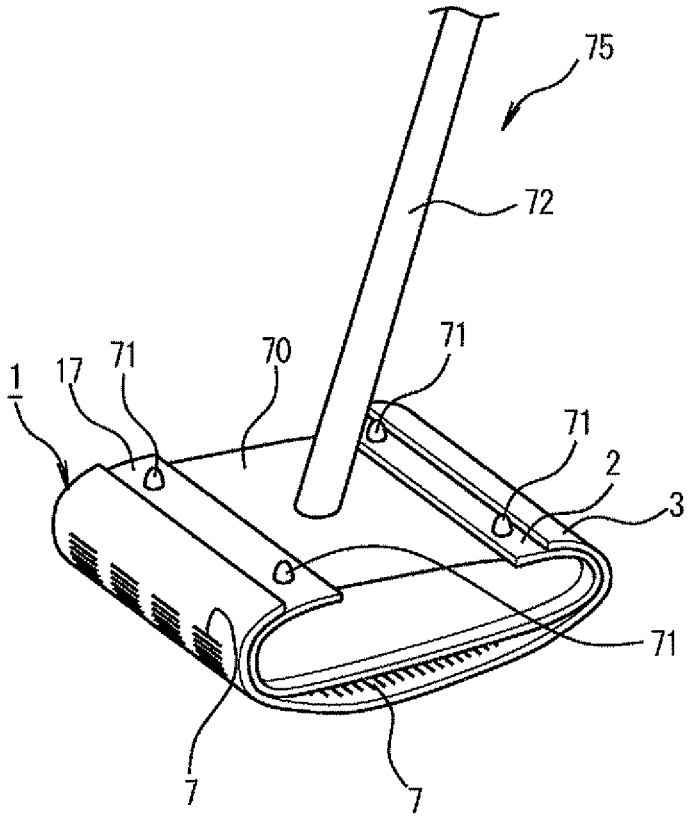
FIG. 5*a* is a perspective view showing a state where the cleaning sheet according to the invention is mounted on a cleaning device.
FIG. 5*b* is a partial longitudinal sectional view of FIG. 5*a*.
Figure 5:
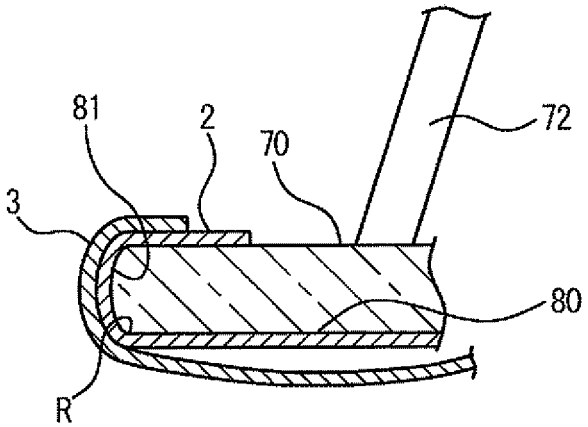

The cleaning sheet according to the invention may be used while being mounted on a cleaning device 75 that includes a long handle 72 and a base plate 70 provided at the end of the long handle as shown in FIG. 5*a*. The cleaning sheet 1 is mounted on the base plate 70. A lower surface 80, a front end surface 81, a rear end surface, and a portion near an upper end portion of the base plate 70 are covered with the cleaning sheet 1 and the mounting sections 17 of the cleaning sheet 1 are locked to locking tools 71 that are provided at the base plate 70, so that the cleaning sheet 1 is fixed to the base plate 70.

In this state, the base material sheet 2 comes into direct contact with the base plate 70 and the cleaning surface forming sheet 3 appears to the outside.

When the cleaning sheet 1 is mounted on the base plate 70, the cuts 7 are positioned so as to correspond to the lower surface 80 of the base plate 70. However, it is preferable that the cuts 7 be positioned so as to reach the front end surface 81 in front of an end portion R of the lower surface 80 of the base plate 70. Meanwhile, it is preferable that the cuts 7 be positioned on the rear end surface as well as the front end surface 81.

There will be described the operation of the invention when the cleaning target surface is cleaned by the cleaning device 75 on which the cleaning sheet 1 is mounted as described above.

Figure 6:
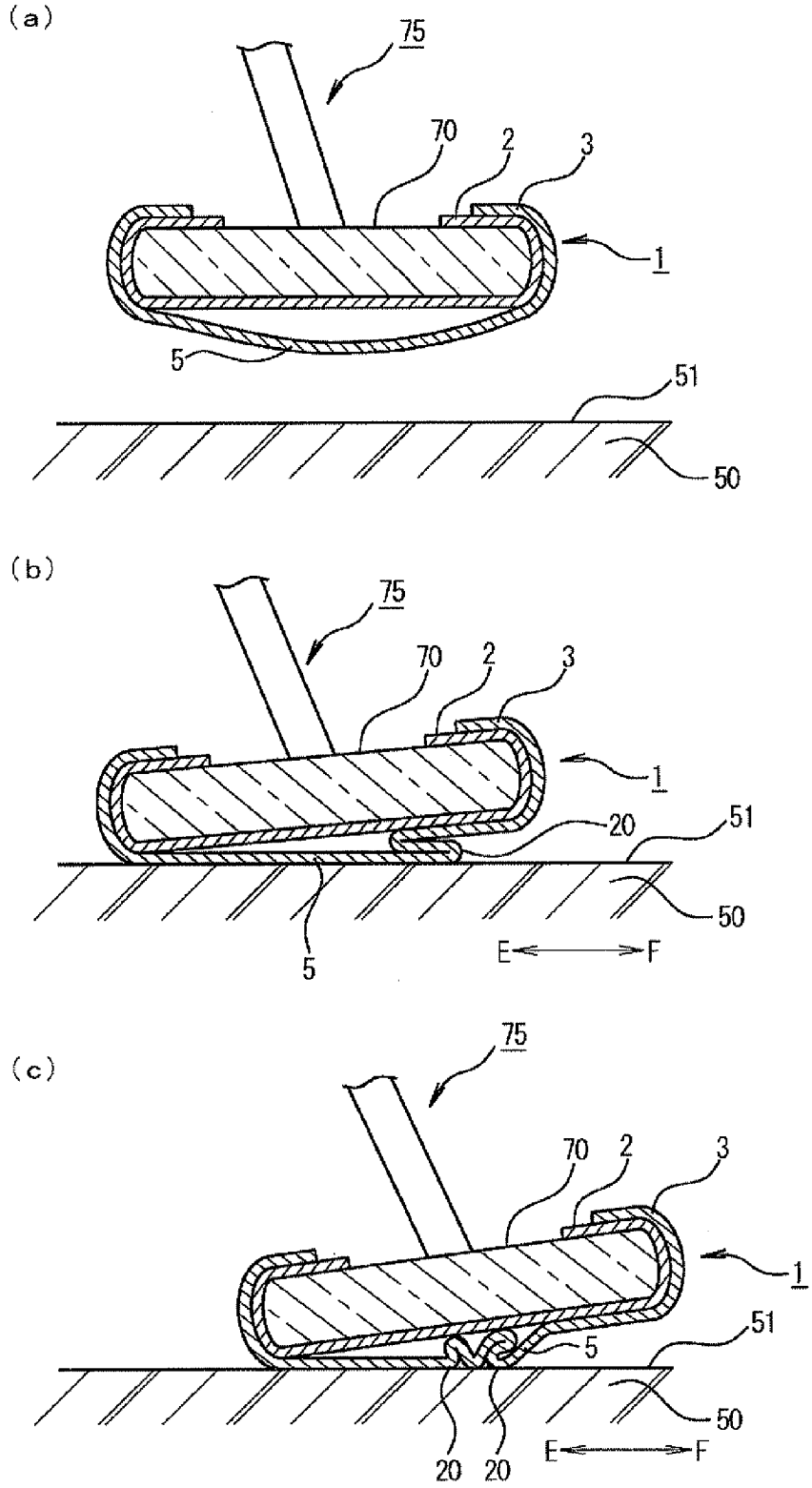
FIGS. 6*a*, 6*b*, and 6*c* are schematic views illustrating the operation of the invention.

As shown in FIG. 6*a*, the cleaning surface forming sheet 3, which faces the cleaning target surface 51 of a floor 50, includes the slacked section 5. When the cleaning surface forming sheet 3 is pressed against the cleaning target surface 51 as shown in FIG. 6*b* and the base plate 70 is moved in the direction of an arrow E-F, creases are formed at the slacked section 5 of the cleaning surface forming sheet 3, so that bent portions 20 are formed.

The shape of the bent portion 20 is irregularly changed according to the moving distance and the moving direction of the base plate 70, and the magnitude of a force that is applied to the cleaning target surface 51 by the base plate 70. The bent portions 20 having the shape shown in FIG. 6*b* are not always formed, and bent portions 20 having the shape shown in, for example, FIG. 6*c* may be formed.

Since the bent portions 20 having an irregular shape are formed at the cleaning surface forming sheet 3 with the movement of the base plate 70 as described above, a frictional force between the cleaning sheet 1 and the cleaning target surface 51 is increased. Due to this large frictional force, dust and dirt are reliably captured by the cuts 7 formed at the cleaning surface forming sheet 3. Accordingly, it may be possible to increase the amount of dust and dirt to be captured.

In particular, when there is used the cleaning sheet (that is, the cleaning sheet according to the embodiment shown in FIG. 1) where the cuts 7 are disposed so that the longitudinal direction of the cuts 7 are parallel to the longitudinal direction of the bonding sections 6, the operational advantage of the invention to be described below becomes conspicuous. Here, the longitudinal direction of the cuts 7 parallel to the longitudinal direction of the bonding sections 6 is the direction of the arrow C-D in FIG. 1.

When there is used the cleaning sheet according to the embodiment shown in FIG. 1, the longitudinal direction of the cuts 7 (the direction of the arrow C-D in FIG. 1) and the moving direction of the base plate 70 (the direction of the arrow E-F in FIGS. 6B and 6C) are orthogonal to each other.

The cuts 7 receive a force in the direction orthogonal to the longitudinal direction of the cut and are pulled due to a frictional force generated when the base plate 70 is moved on the cleaning target surface 51. However, since the bent portions 20 having an irregular shape are formed at the cleaning surface forming sheet 3 as described above, a large frictional force is generated between the cleaning sheet 1 and the cleaning target surface 51. For this reason, a force, which pulls the cuts 7 in the direction orthogonal to the longitudinal direction of the cut 7, is also increased. As a result, the gaps of the cuts 7 are largely opened, so that dust and dirt are easily captured by the cuts 7 and the amount of dust and dirt to be captured is also increased. Therefore, a wiping capacity is improved.

When the cuts 7 are disposed as shown in FIG. 4*b* so that the longitudinal directions of the cuts 7 (the direction of the arrow A-B in FIG. 4*b*) are orthogonal to the longitudinal direction of the bonding section 6(FIG. 1*a*) (the direction of the arrow C-D in FIG. 4*b*), that is, even when the longitudinal directions of the cuts 7 are parallel to the moving direction of the base plate 70 (the direction of the arrow E-F in FIGS. 6*b* and 6*c*), a frictional force caused by the above-mentioned bent portions 20 is increased. Due to this large frictional force, dust and dirt are efficiently captured by the cuts 7.

The operational advantage, which is obtained from the formation of the bent portions 20 having an irregular shape during cleaning, is the same as described above. However, in addition to the above-mentioned advantage, there also is an advantage of easily removing dirt by entangling dirt with the bent portions 20 when the bent portions 20 are formed.

The cleaning sheet according to the invention is not limited to the cleaning device 75 where the base plate 70 is provided at the end of the long handle 72 shown in FIG. 5*a*, and may be applied to a cleaning device that includes a relatively short grip handle and an insertion leg part. When the cleaning sheet according to the invention is to be applied to the cleaning device that includes the grip handle and the leg part, a holding portion to which the leg part is inserted is formed on the surface of the base material sheet 2 opposite to the cleaning surface forming sheet 3 and the leg part is inserted to the holding portion, so that the cleaning sheet according to the invention is held on the grip handle. Accordingly, it may be possible to grip the grip handle by hands and perform cleaning.

Further, the cleaning sheet according to the invention may be formed of a glove structure (mitten), and it may be possible to perform cleaning while a hand is put in a glove which has the glove structure.

Both when the cleaning sheet according to the invention is held on the grip handle during use and when the cleaning sheet according to the invention is used as a glove structure, the same operational advantage as described above is obtained.

Although not particularly shown in the cleaning sheet according to the invention, a plurality of minute concavities and convexities may be formed on the cleaning surface forming sheet 3 by the embossing performed on the cleaning surface forming sheet 3. If the plurality of minute concavities and convexities is formed on the cleaning surface forming sheet 3, the operation for capturing dust and dirt is further improved.

Figure 2:
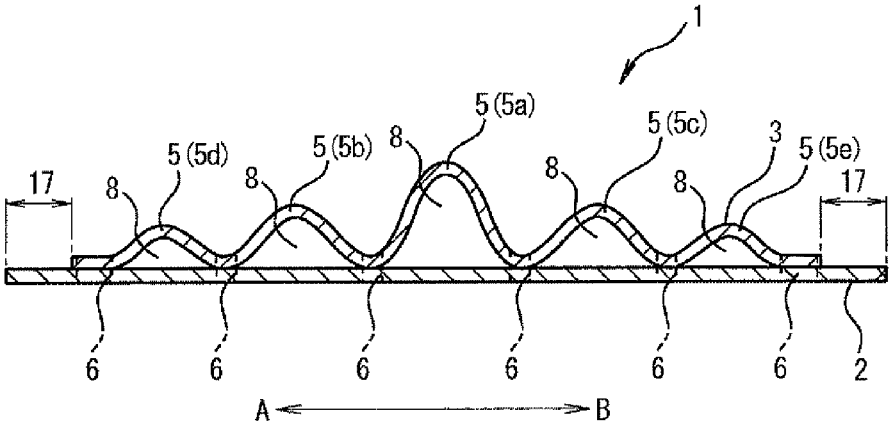
FIG. 2 is a longitudinal sectional view of an embodiment of the invention where a plurality of slacked sections is formed.

As shown in FIG. 2, it may be possible to form a plurality of slacked sections on the cleaning surface forming sheet 3 by providing a plurality of bonding sections 6 where the base material sheet 2 and the cleaning surface forming sheet 3 are bonded to each other. Five slacked sections 5*a*, 5*b*, 5*c*, 5*d*, and 5*e* are formed in an embodiment shown in FIG. 2.

The plurality of slacked sections 5*a*, 5*b*, 5*c*, 5*d*, and 5*e* is lined up in the direction of the arrow A-B. That is, a plurality of bonding sections 6 where the base material sheet 2 and the cleaning surface forming sheet 3 are bonded to each other is formed at predetermined intervals, and a slacked section 5*a*,5*b*,5*c*,5*d*, or 5*e* is protrudingly formed between the bonding sections 6 and 6 provided adjacently each other. Each of the slacked sections 5*a*, 5*b*, 5*c*, 5*d*, and 5*e* has a space 8.

The distances between the respective bonding sections 6 and 6 may be equal to each other or may be different from each other. That is, a plurality of columns of slacked sections 5*a*, 5*b*, 5*c*, 5*d*, and 5*e* having the same width may be formed, or a plurality of columns of slacked sections 5*a*, 5*b*, 5*c*, 5*d*, and 5*e* having different widths may be formed.

Further, all the slacked sections 5*a*, 5*b*, 5*c*, 5*d*, and 5*e* may be formed so as to have the same height, or may be formed so as to have the different heights between the slacked sections. For example, in the embodiment shown in FIG. 2, the slacked section 5*a* formed in the middle portion of the cleaning surface forming sheet 3 is formed so as to be the highest and the slacked sections are formed so that the heights of the slacked sections are gradually reduced toward in a direction of the both end portions of the cleaning surface forming sheet 3.

Figure 7:
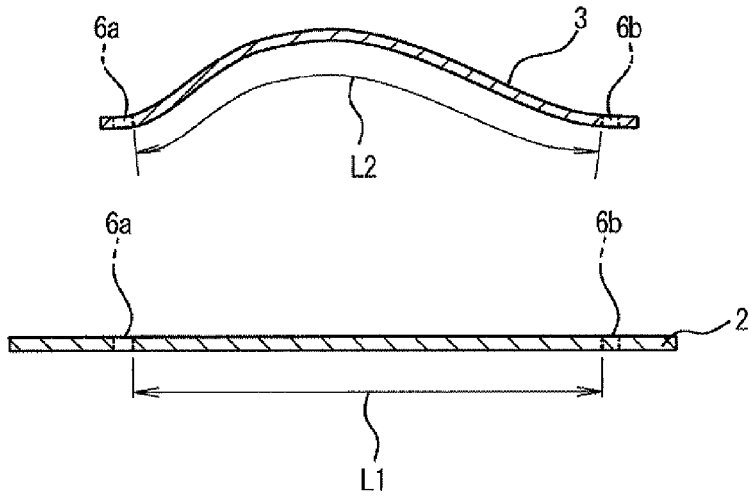
FIGS. 7*a* and 7*b* are explanatory views illustrating a relationship between a distance L1 along a base material sheet between bonding sections where the base material sheet and a cleaning surface forming sheet are bonded to each other, and a distance L2 along the cleaning surface forming sheet between the bonding sections.
Figure 7:
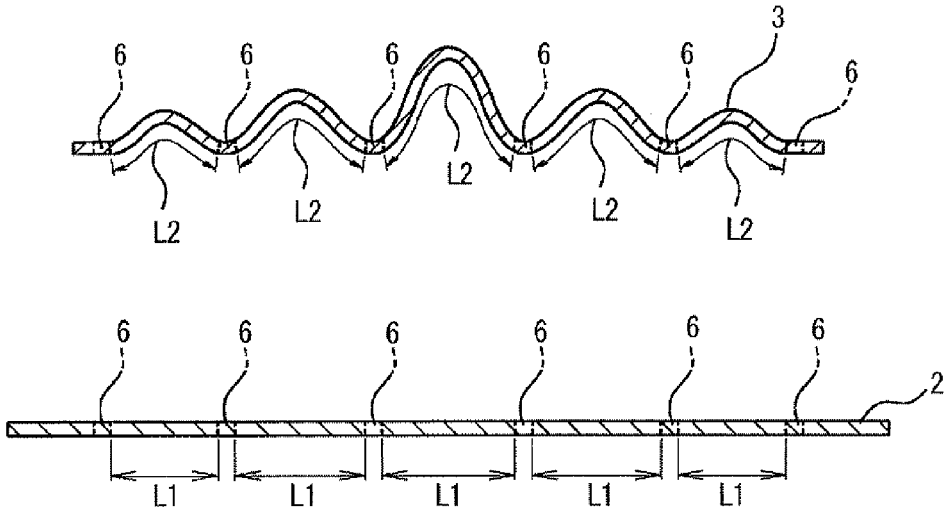

In this structure, as shown in FIG. 7*b*, at each of the slacked sections 5 of the cleaning surface forming sheet 3, a distance L1 along the base material sheet 2 between the bonding sections 6 and 6 of the base material sheet 2 bonded with the cleaning surface forming sheet 3 and a distance L2 along the cleaning surface forming sheet 3 between the bonding sections 6 and 6 of the cleaning surface forming sheet 3 bonded with the base material sheet 2 are satisfied with a relationship expressed by a formula of "L1<L2". That is, L1 denotes a horizontal straight-line distance between the bonding sections 6 and 6 on the base material sheet 2, and L2 denotes a horizontal straight-line distance between the bonding sections 6 and 6 when the cleaning surface forming sheet 3 is flattened.

In general, when a cleaning sheet is mounted on the cleaning device and a floor is cleaned by the cleaning sheet, dust and dirt tend to be locally captured at a specific portion of the cleaning sheet without being uniformly captured over the entire surface of the cleaning sheet. The portion where dust and dirt are locally captured is generally a portion of the cleaning sheet that corresponds to the front end portion of the base plate of the cleaning device. Accordingly, the amount of dust and dirt to be captured is relatively small in the vicinity of the middle of the cleaning sheet.

Therefore, if the slacked section 5*a* formed in the middle portion of the cleaning surface forming sheet 3 is formed so as to be the highest and the slacked sections are formed so that the heights of the slacked sections are gradually reduced toward the end portions of the cleaning surface forming sheet 3 as described above, a force is reliably applied during cleaning even in the vicinity of the middle of the cleaning sheet. For this reason, a required wiping force is applied not only in the vicinity of the front end of the cleaning sheet but also in the vicinity of the middle of the cleaning sheet. As a result, it may be possible to uniformly capture dust and dirt over the entire cleaning sheet.

Figure 3:
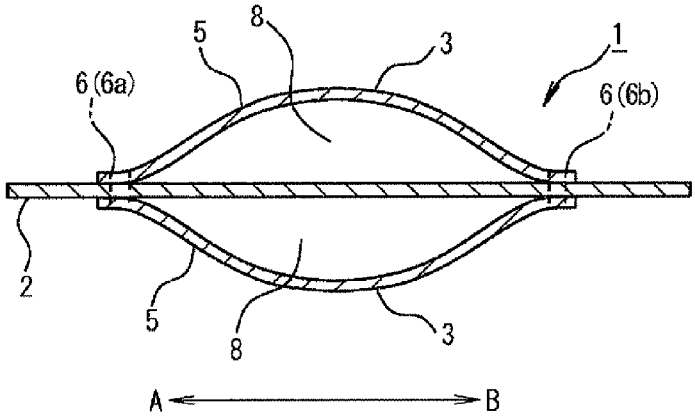
FIG. 3 is a longitudinal sectional view of an embodiment of the invention where a cleaning surface forming sheet is respectively provided on front and back surfaces of a base material sheet.

The invention is not limited to the embodiment where the cleaning surface forming sheet 3 including a plurality of cuts 7 is bonded to one surface of the base material sheet 2 while being slack, and the cleaning surface forming sheet 3 may be respectively bonded to the front and back surfaces of the base material sheet 2 as shown in FIG. 3.

Figure 8:
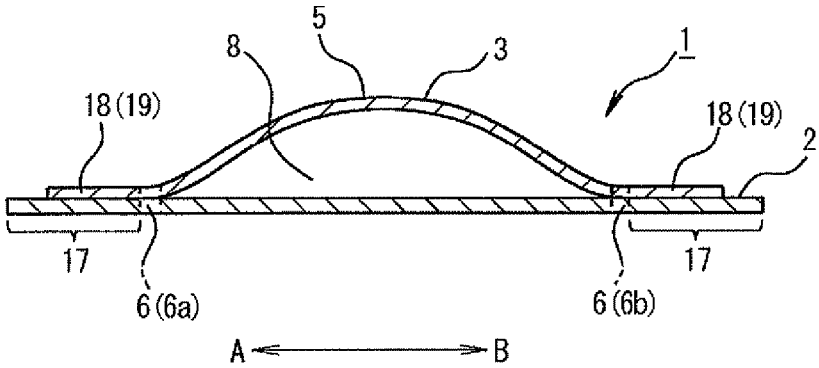
FIG. 8 is a longitudinal sectional view of another embodiment of the invention.

In the invention, as shown in FIG. 8, the bonding sections 6 where the cleaning surface forming sheet 3 and the base material sheet 2 are bonded to each other are not positioned at the end edge portions of the cleaning surface forming sheet 3 and may be positioned at the portions inside the end edge portions. That is, it may be possible to form bonding sections 6 by bonding the portions inside the end edge portions of the cleaning surface forming sheet 3 to the base material sheet 2.

Accordingly, extension portions 18 of the cleaning surface forming sheet 3 are formed between the bonding sections 6 and the end edge portions of the cleaning surface forming sheet 3. The extension portions 18 are formed as end-cleaning surfaces 19.

Figure 11:
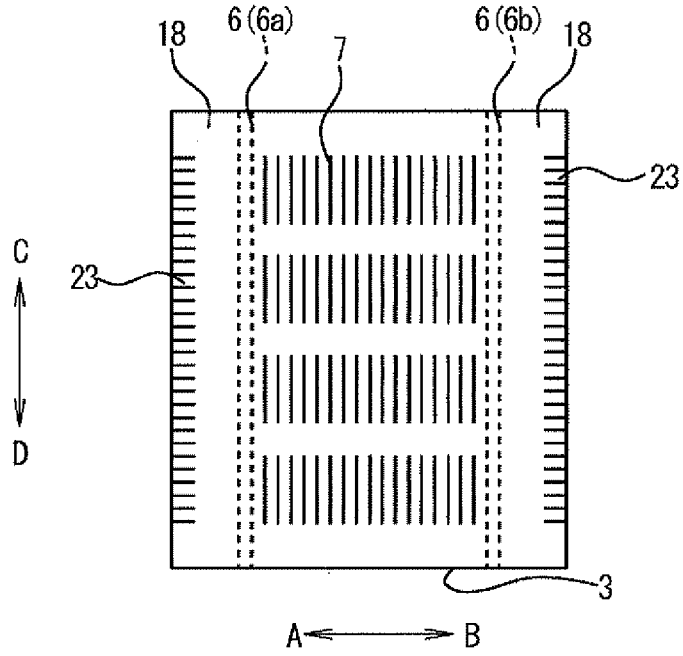
FIGS. 11*a* and 11*b* are plan views of other embodiments of the invention.
Figure 11:
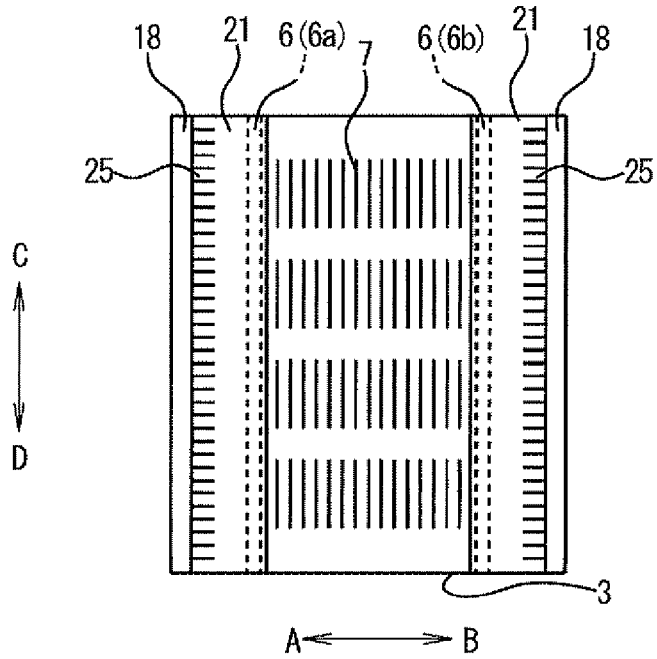

Many cuts are formed at the extension portions 18 as shown in FIG. 11*a*, so that a plurality of strip sections 23 are formed. If the strip sections 23 are formed, it may be possible to wipe out dust and dirt even by the strip sections 23.

Figure 16:
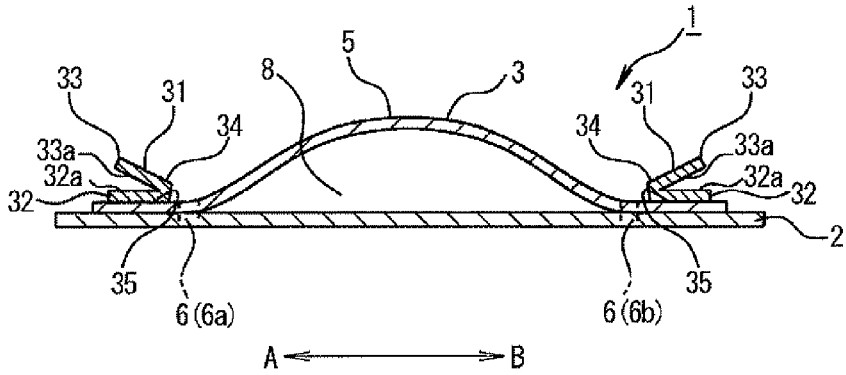
FIG. 16 is a longitudinal sectional view of another embodiment of the invention.
Figure 17:
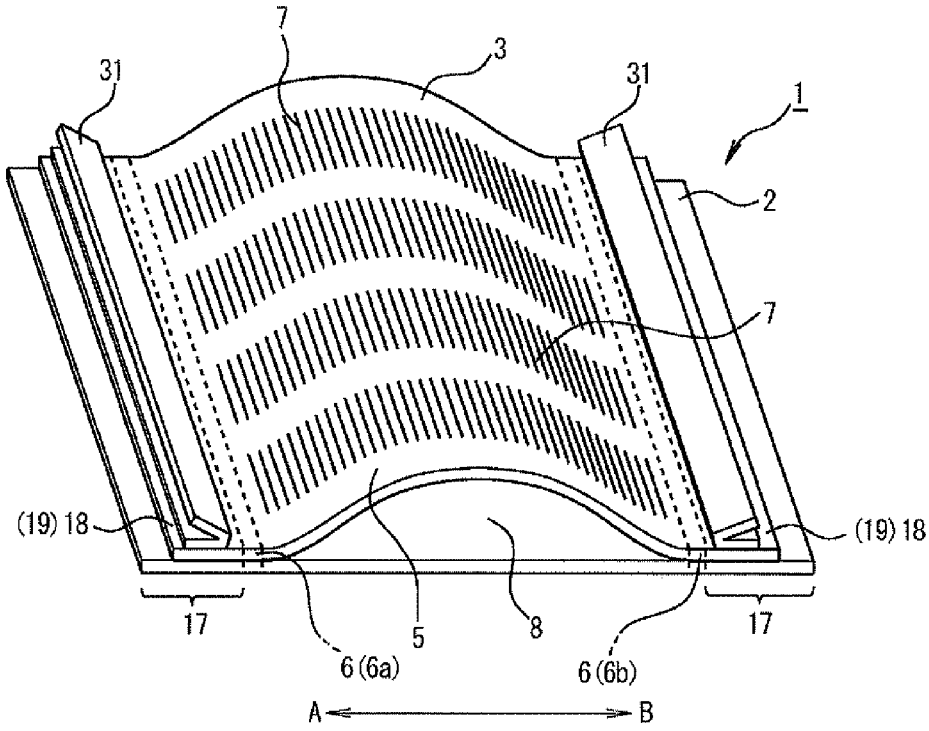
FIG. 17*a* is a perspective view of another embodiment of the invention.
FIG. 17*b* is a schematic view illustrating the operation of the invention when a cleaning sheet shown in FIG. 17*a* is mounted on a cleaning device and cleaning is performed.
Figure 17:
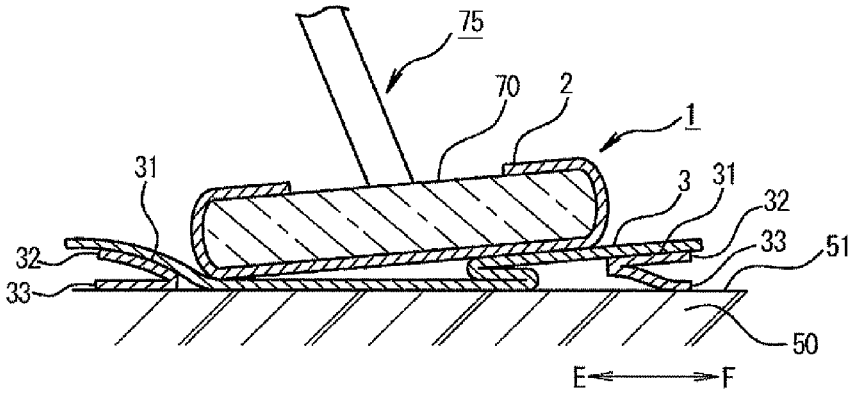

As shown in FIGS. 16, 17*a*, and 17*b*, folded plate 31 may be provided, or mounted, at the left and right extension portions 18 of the cleaning surface forming sheet 3 in the longitudinal direction of the extension portion, respectively. As shown in FIG. 16, the folded plate 31 has the shape of one elongated sheet folded into two and includes a base portion 32 and a slope portion 33 folded and extended from the base portion 32. The slope portion 33 rises at a predetermined angle about a folded portion 34 as a basepoint.

The folded plates 31 are bonded to the extension portions 18 by heat sealing or an adhesive. Reference numeral 35 denotes a bonding section where the extension portions 18 and the folded plate 31 are bonded to each other.

An adhesive is applied to the surface of the slope portion 33 facing the base portion 32 or an adhesive tape is attached to the slope portion 33 facing the base portion 32, so that an adhesive surface 33*a* is formed. Meanwhile, a release agent is applied to the surface of the base portion 32 facing the slope portion 33 or a release tape is attached to the surface of the base portion 32 facing the slope portion 33, so that a release surface 32*a* is formed. The release surface 32*a* prevents the slope portion 33 having the adhesive surface 33*a* and the base portion 32 from being bonded to each other after the slope portion 33 and the base portion 32 come into contact with each other. An adhesive and a release agent, which are well known in the related art, may be used as the adhesive and the release agent.

The folded plate 31 is made of a material, such as plastic or nonwoven fabric. If the folded plate 31 is made of a plastic material, it may be possible to make the slope portion 33 function as an elastic piece. As the plastic material, polypropylene, polyethylene, PET, and the like may be used.

It may be possible to produce the folded plate 31 by folding a sheet material, which is made of plastic, nonwoven fabric, or the like, into two in a longitudinal direction. Further, the folded plate 31 may be manufactured by means of injection molding, extrusion molding, or the like of a plastic material.

When the cleaning sheet 1 provided with the folded plate 31 is mounted on the base plate 70 of the cleaning device 75 and the cleaning target surface 51 is cleaned by the cleaning sheet as shown in FIG. 17*b*, the slope portion 33 of the folded plate 31 functions to catch dust and dirt and sweep dust and dirt off in one direction. In this way, the folded plate 31 functions as the end-cleaning surfaces 19.

Further, since a gap is formed between the slope portion 33 and the base portion 32, big dirt enters the gap. Here, since the adhesive surface 33*a* is formed on the inner surface of the slope portion 33, big dirt having entered the gap is reliably captured by the adhesive surface 33*a*. If the folded plate 31 above-mentioned is provided, there is an advantage of easily capturing and removing relatively big and heavy dirt like granulated dirt.

Figure 12:
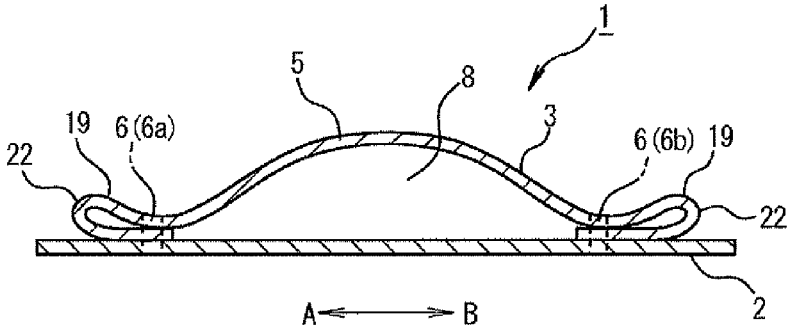
FIG. 12 is a longitudinal sectional view of another embodiment of the invention.

When the cleaning surface forming sheet 3 is to be bonded to the base material sheet 2, both the left and right end edge portions of the cleaning surface forming sheet 3 are folded inward so that curvedly folded portions 22 are formed as shown in FIG. 12. Bonding means such as heat sealing may be performed at the positions of these curvedly folded portions 22 so that the cleaning surface forming sheet 3 and the base material sheet 2 are bonded to each other. The base end portions of the curvedly folded portions 22 are respectively bonded in FIG. 12, so that the bonding sections 6*a* and 6*b* are formed.

Figure 13:
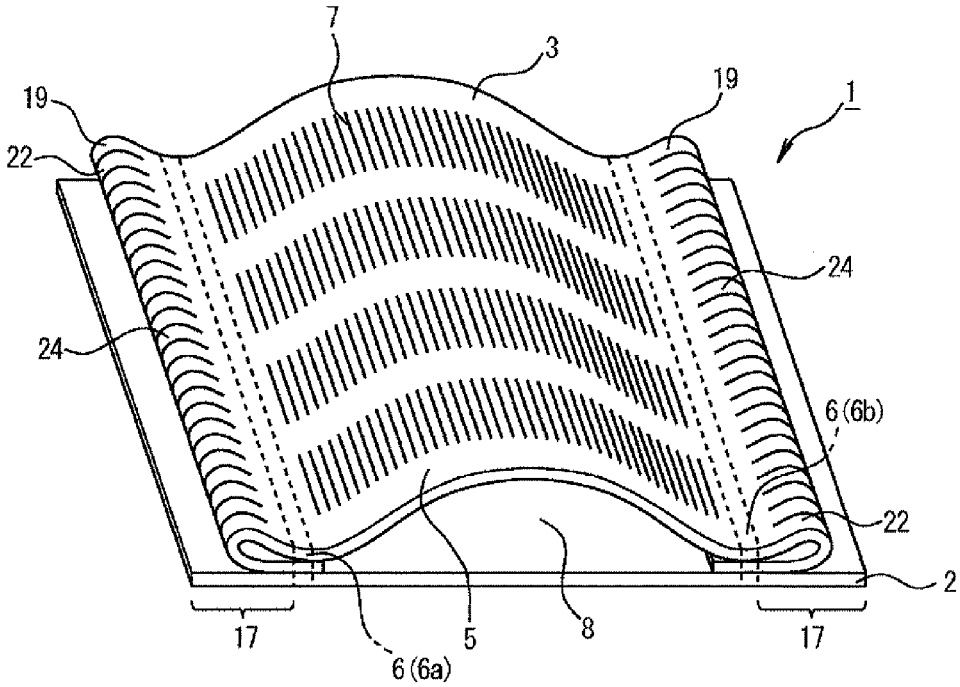
FIG. 13 is a perspective view of another embodiment of the invention.

Furthermore, it may be possible to form hollow strip sections 24 at both left and right end portions of the cleaning surface forming sheet 3 as shown in FIG. 13 by forming many cuts at the curvedly folded portions 22.

If the hollow strip sections 24 are formed, the hollow strip sections 24 wipe out dust and dirt. Accordingly, there is an advantage of improving cleaning efficiency. In this way, the curvedly folded portions 22 function as the end-cleaning surfaces 19.

Figure 9:
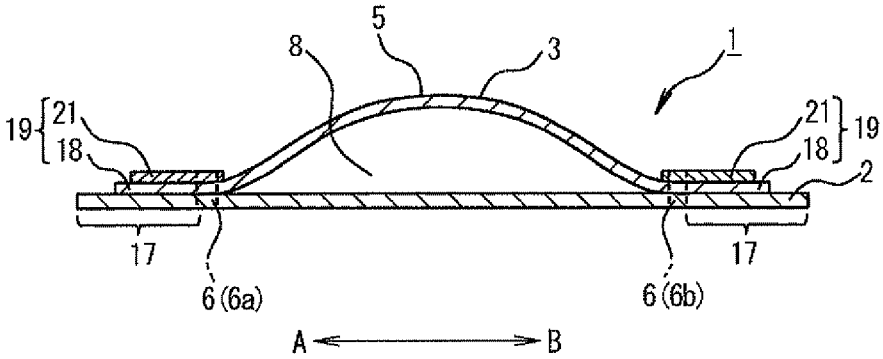
FIGS. 9*a* and 9*b* are longitudinal sectional views of other embodiments of the invention.
Figure 9:
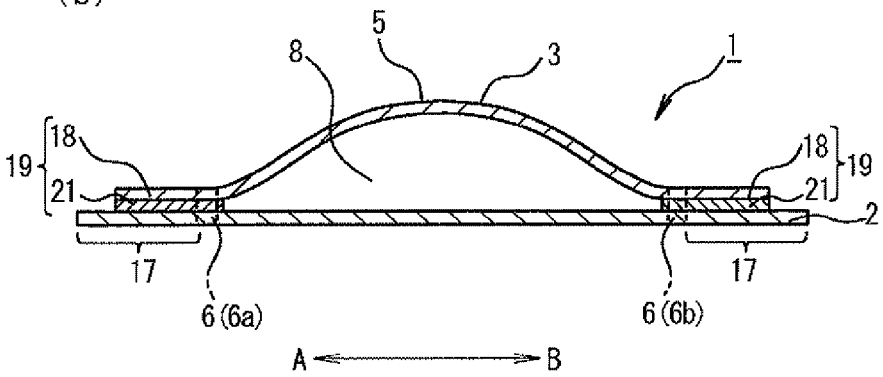

As shown in FIG. 9*a*, band pieces 21 may be provided on the upper surfaces of the extension portions 18, which are formed at both left and right end portions of the cleaning surface forming sheet 3, respectively. Each of the band pieces 21 are bonded to the extension portions 18 in the longitudinal direction of the bonding sections 6 (the direction of the arrow C-D in FIG. 1) by bonding means, such as heat sealing or adhesion using an adhesive.

Nonwoven fabric, plastic, and the like may be used as the material of the band piece 21, but nonwoven fabric is preferable. Nonwoven fabric, which is made of the same material as the material of the nonwoven fabric used for the cleaning surface forming sheet 3, may be used as the nonwoven fabric.

As shown in FIG. 11*b*, it may be possible to form strip sections 25 by forming many cuts at the extension portions 18 and the band pieces 2, respectively.

As shown in FIG. 9*b*, the extension portion 18 of the cleaning surface forming sheet 3 and the base material sheet 2 may be bonded to each other with the band piece 21 interposed therebetween.

Figure 10:
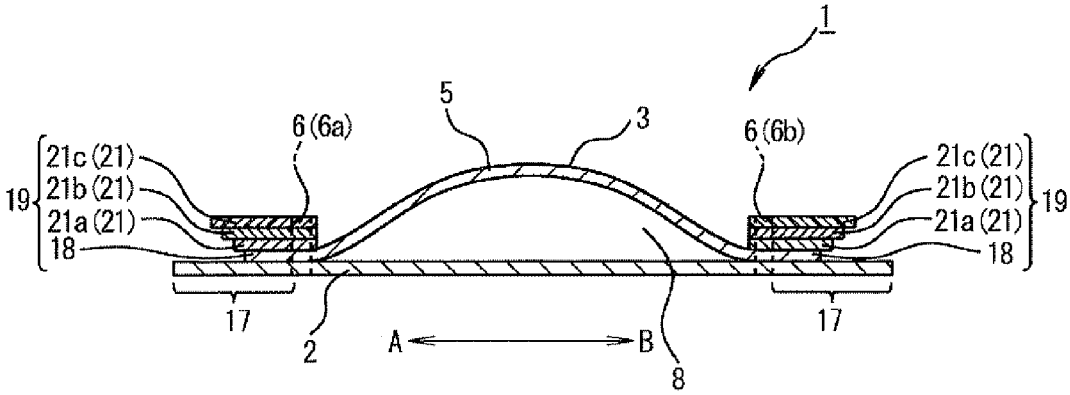
FIG. 10 is a longitudinal sectional view of another embodiment of the invention.

FIG. 10 shows an embodiment where a plurality of band pieces 21*a*, 21*b*, and 21*c* is laminated on each of the extension portions 18 of the cleaning surface forming sheet 3. The widths of the plurality of band pieces 21*a*, 21*b*, and 21*c* (the lengths of the band pieces in a direction orthogonal to the longitudinal direction of the band piece) may be equal to each other or may be different from each other. If the widths of the band pieces are different from each other, it is preferable that the width of the uppermost layer (band piece 21*c*) of a laminated body of the band pieces be largest as shown in FIG. 10.

According to this structure, it is easy to clean the corner portions of a floor when the floor is cleaned. That is, the band piece 21*c*, which is the uppermost layer of the laminated body of the band piece, enters the corner portion of the floor, so that it may be possible to wipe out dust and dirt of the corner portion.

As described above, the band pieces 21 provided on the extension portions 18 also function as the end-cleaning surfaces 19.

Figure 14:
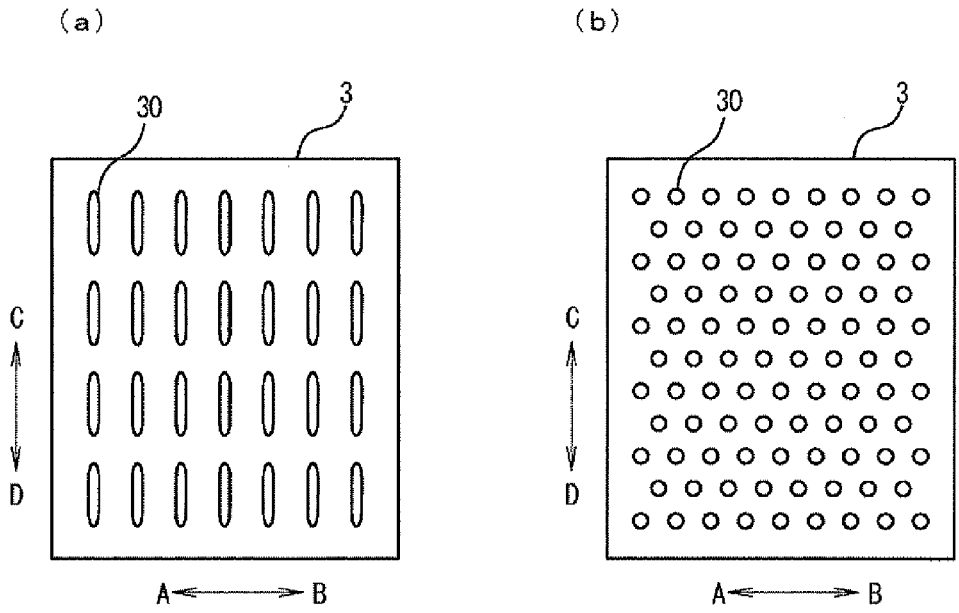
FIGS. 14*a* and 14*b* are plan views of cleaning surface forming sheets where through holes are formed as cut portions.

The case where the cut portions formed at the cleaning surface forming sheet are formed of the cuts 7 has been described in the above-mentioned embodiments of the invention. However, the invention is not limited thereto, and the cut portions may be through holes as shown in FIG. 14. That is, the cut portions may be formed of a slit-like or oval through holes 30 as shown in FIG. 14*a*, and the cut portions may be circularly formed for through holes 30 as shown in FIG. 14*b*. The shape of the through holes 30 may be optionally designed, and may be a quadrangular shape, a diamond shape, or the like.

Figure 15:
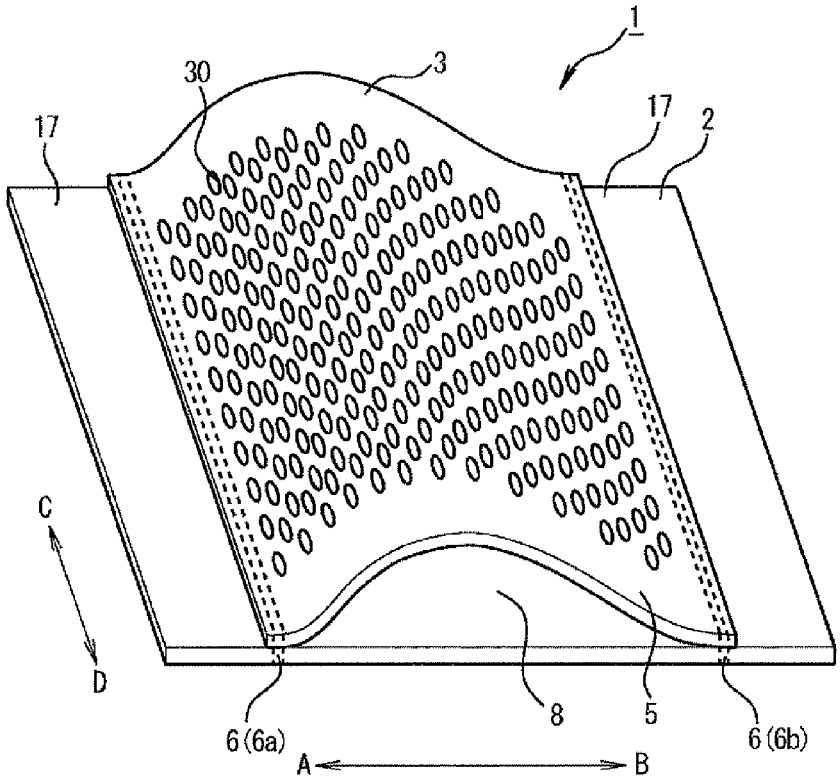
FIG. 15 is a perspective view of an embodiment of the invention where through holes are formed as cut portions.

A cleaning sheet where the through holes 30 are formed at the cleaning surface forming sheet 3 is shown in FIG. 15.

Even when cleaning is performed using the cleaning sheet where a plurality of through holes 30 are formed at the cleaning surface forming sheet 3, the same operational advantage as described above is obtained. In this case, dust and dirt are captured by the through holes 30 and the dust and dirt are wiped out.

In another embodiment of the invention, the cleaning sheet may additionally have a function of capturing dirt by an adhesive as described below.

Figure 18:
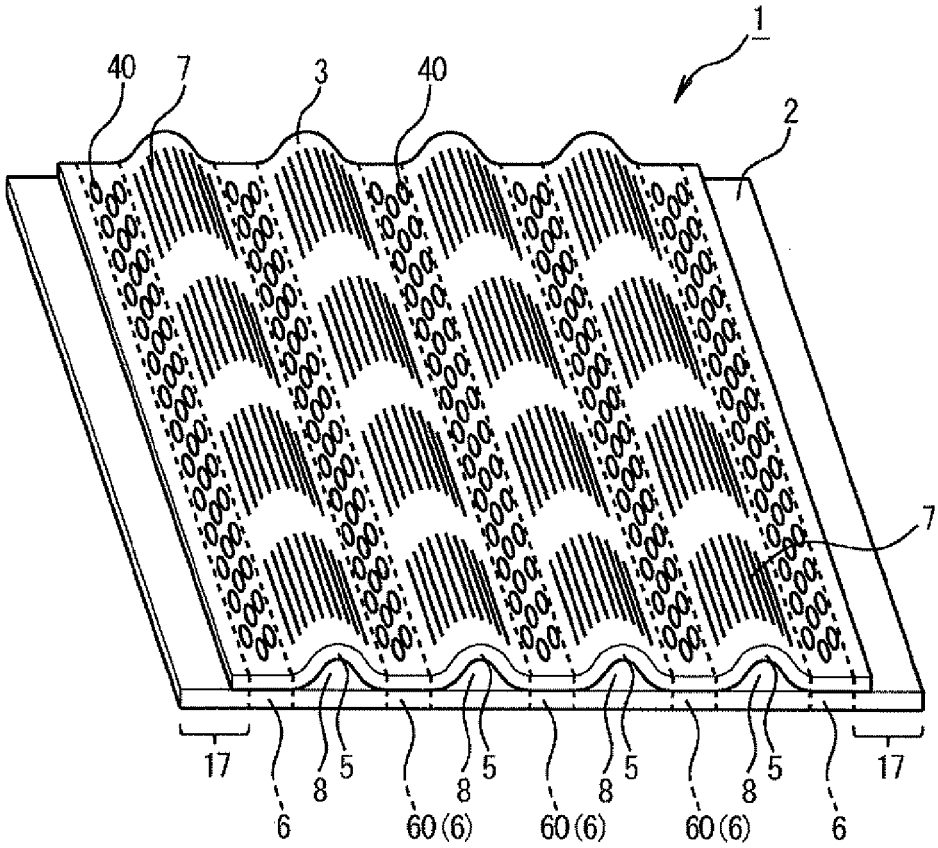
FIG. 18 is a perspective view of another embodiment of the invention.

As shown in FIG. 18, a plurality of slacked sections 5 is formed at the cleaning surface forming sheet 3 and flat sections 60 are formed between the slacked sections 5, respectively. Further, flat sections 60 are also formed between the slacked sections 5 and the end portions of the cleaning surface forming sheet 3. These flat sections 60 are attached to the base material sheet 2 by an adhesive. The flat sections 60 are attached to the base material sheet 2, so that the flat sections 60 form bonding sections 6 where the cleaning surface forming sheet 3 and the base material sheet 2 are bonded to each other.

Cuts 7 are formed at each of the plurality of slacked sections 5. Meanwhile, a plurality of opening holes 40 are formed at each of the plurality of flat sections 60. An adhesive layer, which is formed inside the flat sections 60, is exposed to the outside through these opening holes 40.

An adhesive, which maintains adhesion even at normal temperature, is used as the adhesive that is used to attach the flat sections 60 to the base material sheet 2. A hot-melt adhesive, a two-liquid type curable adhesive, a thermoplastic resin adhesive, an elastomeric adhesive, a thermosetting resin adhesive, an instant adhesive, and the like may be appropriately used as the adhesive. Among them, a hot-melt adhesive is preferable. Item No. "5Q122E" or "DMC5266" manufactured by National Starch & Chemical (Shanghai) Ltd. may be used as the hot-melt adhesive.

When the cleaning target surface is cleaned using the cleaning sheet having the above-mentioned structure, not only a function of capturing dust and dirt by the cleaning surface forming sheet 3 including the cuts 7 as described above but also the following function is exerted.

That is, when the cleaning sheet is pressed against the cleaning target surface, the surface of the adhesive layer exposed to the outside through the opening holes 40 comes into contact with the cleaning target surface. Accordingly, relatively big granulated dirt, which is generally difficult to be captured, also adheres to the cleaning sheet due to the adhesion of the adhesive, so that it may be possible to remove the relatively big granulated dirt from the cleaning target surface. As described above, light and small dirt is generally captured by the surfaces of the slacked sections 5 and heavy and big dirt is captured by the surfaces of the flat sections 60.

Here, the adhesive layer, which is exposed to the outside through the opening holes 40, exists at recessed portions between the slacked sections 5 formed protrudingly. Accordingly, there is no concern that the exposed portion of the adhesive layer excessively adheres to the cleaning target surface and the movement of the cleaning device is suppressed.

In the embodiment of the invention shown in FIG. 18, the cuts 7 have been formed at the slacked sections 5. However, in another embodiment of the invention, the through holes 30 shown in FIGS. 14A and 14B may be formed instead of the cuts 7.

Figure 19:
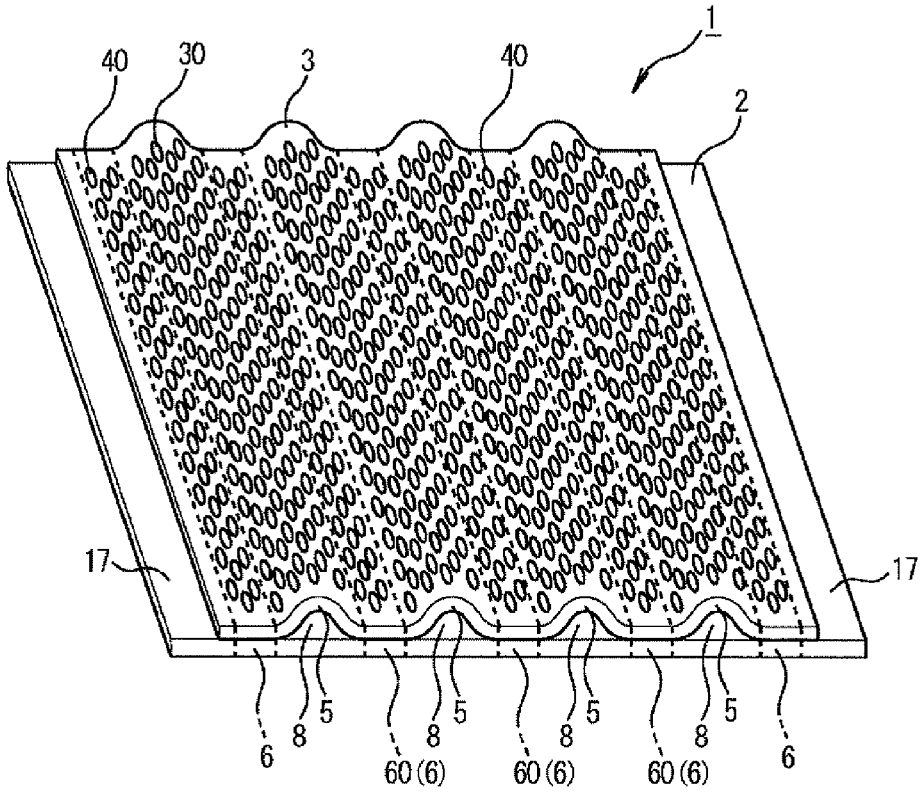
FIG. 19 is a perspective view of another embodiment of the invention.

An embodiment where through holes 30 are formed instead of the cuts 7 as described above is shown in FIG. 19. The cleaning sheet shown in FIG. 19 includes flat sections 60 including opening holes 40 and slacked sections 5 including through holes 30. The cleaning sheet according to this embodiment also has the same operation as the operation of the cleaning sheet shown in FIG. 18. Light and small dirt is generally captured by the surfaces of the slacked sections 5 and heavy and big dirt is captured by the surfaces of the flat sections 60.

The cleaning sheet according to the invention is not limited to a cleaning sheet that is used while being mounted a cleaning device, and may be used for cleaning while being directly gripped in the form of a sheet by a hand.

Further, the cleaning sheet according to the invention may be applied to clean various objects to be cleaned, such as walls, windows, ceilings, desks, and furniture, other than a floor, and is not limited to the purpose to clean specific objects.

Industrial Applicability

The invention may be used to clean a floor after being mounted on, for example, a cleaning device for a floor and is useful as a cleaning sheet of which cleaning ability can be improved.

The invention claimed is:

1. A cleaning sheet comprising:

a base material sheet;

a cleaning surface forming sheet being bonded to a surface of the base material sheet;

a plurality of bonding sections being defined where the base material sheet and the cleaning surface forming sheet are bonded to each other, and being formed in a direction parallel to end edge portions of the base material sheet;

a plurality of slacked sections being arranged to the cleaning surface forming sheet between the bonding sections where the base material sheet and the cleaning surface forming sheet are bonded to each other; and a plurality of cut portions for capturing dust and dirt being formed at each of the plurality of slacked sections, wherein flat sections including a plurality of opening holes are formed between the plurality of slacked sections, and each of the flat sections is bonded to the base material sheet by an adhesive to form the bonding sections.

2. The cleaning sheet according to claim 1, wherein an adhesive layer is formed between the plurality of flat sections and the base material sheet, and the adhesive layer is exposed to the outside through the opening holes of the plurality of flat sections.

3. The cleaning sheet according to claim 1, wherein another cleaning surface forming sheet is bonded to another surface of the base material sheet.

4. The cleaning sheet according to claim 3, wherein an adhesive layer is formed between the plurality of flat sections and the base material sheet, and the adhesive layer is exposed to the outside through the opening holes of the plurality of flat sections.

5. The cleaning sheet according to claim 1, wherein each of the base material sheet and the cleaning surface forming sheet is formed of nonwoven fabric.

6. The cleaning sheet according to claim 5, wherein an adhesive layer is formed between the plurality of flat sections and the base material sheet, and the adhesive layer is exposed to the outside through the opening holes of the plurality of flat sections.

7. The cleaning sheet according to claim 1, wherein the plurality of cut portions is formed by slits provided on the cleaning surface forming sheet.

8. The cleaning sheet according to claim 7, wherein an adhesive layer is formed between the plurality of flat sections and the base material sheet, and the adhesive layer is exposed to the outside through the opening holes of the plurality of flat sections.

9. The cleaning sheet according to claim 1, wherein the plurality of cut portions is formed by through holes provided on the cleaning surface forming sheet.

10. The cleaning sheet according to claim 9, wherein an adhesive layer is formed between the plurality of flat sections and the base material sheet, and the adhesive layer is exposed to the outside through the opening holes of the plurality of flat sections.

* * * * *